US010582815B1

(12) United States Patent
Josey

(10) Patent No.: US 10,582,815 B1
(45) Date of Patent: Mar. 10, 2020

(54) BODY AIR DRYER FOR A BATHING STALL

(71) Applicant: Randy Josey, Harmony, NC (US)

(72) Inventor: Randy Josey, Harmony, NC (US)

( * ) Notice: Subject to any disclaimer, the term of this patent is extended or adjusted under 35 U.S.C. 154(b) by 301 days.

(21) Appl. No.: 15/701,574

(22) Filed: Sep. 12, 2017

(51) Int. Cl.
*A47K 10/48* (2006.01)

(52) U.S. Cl.
CPC ..... *A47K 10/48* (2013.01)

(58) Field of Classification Search
None
See application file for complete search history.

(56) References Cited

U.S. PATENT DOCUMENTS 2,977,455 A * 3/1961 Murphy ..... A47K 10/48 392/381
3,878,621 A * 4/1975 Duerre ..... A45D 20/16 34/90
4,780,595 A * 10/1988 Alban ..... A45D 20/16 392/364
4,857,705 A * 8/1989 Blevins ..... A47K 10/48 392/381
D311,070 S * 10/1990 Blevins ..... D28/54.1
4,961,272 A * 10/1990 Lee ..... A47K 10/48 34/202
5,007,182 A * 4/1991 Fishman ..... A47K 10/48 34/202
5,099,587 A 3/1992 Jarosch
5,103,577 A * 4/1992 Michaels ..... A47K 10/48 34/91
5,377,424 A * 1/1995 Albanes ..... A47K 10/48 34/233
6,148,539 A * 11/2000 Hatfield ..... A47K 10/48 34/223
6,718,650 B2 * 4/2004 Ross ..... A47K 10/48 236/13
6,842,581 B2 * 1/2005 Schafer ..... A47K 10/48 34/90
6,962,005 B1 * 11/2005 Khosropour ..... A47K 10/48 34/218
6,973,260 B2 * 12/2005 Orr ..... F24H 3/0417 392/360
7,013,504 B2 * 3/2006 Brunelle ..... A61H 33/06 4/524
7,076,887 B1 * 7/2006 Camberos ..... A47K 10/48 34/201

(Continued)

FOREIGN PATENT DOCUMENTS

FR 2923148 11/2007

*Primary Examiner* — Thor S Campbell
(74) *Attorney, Agent, or Firm* — Kyle A. Fletcher, Esq.

(57) ABSTRACT

The body air dryer for a bathing stall is a forced air drying system. The body air dryer for a bathing stall is configured for use with a shower stall. The body air dryer for a bathing stall is configured for use with a bather. The body air dryer for a bathing stall discharges heated air on to the bather for the purpose of drying the bather after bathing. The body air dryer for a bathing stall comprises a housing, a forced air system, a power circuit, and a water muffler. The forced air system, the power circuit, and the water muffler are contained within the housing. The forced air system discharges heated air on the bather. The power circuit connects the forced air system to an external power source. The water muffler is a structure that prevents water from entering the forced air system and the power system.

18 Claims, 6 Drawing Sheets

(56) References Cited

U.S. PATENT DOCUMENTS

| | | | | |
|---|---|---|---|---|
| D534,306 | S | 12/2006 | Butler | |
| 7,158,716 | B2 * | 1/2007 | Shapiro | F04D 17/04 392/365 |
| D538,976 | S * | 3/2007 | Navas | D23/335 |
| 7,900,371 | B1 * | 3/2011 | Bullard | A47K 10/48 34/202 |
| 8,438,753 | B2 * | 5/2013 | Martin | A47K 3/281 236/94 |
| 9,615,702 | B2 * | 4/2017 | Calpe Gargallo | A47K 10/48 |
| 2004/0200089 | A1 * | 10/2004 | Melendrez | A47K 10/48 34/90 |
| 2005/0086735 | A1 * | 4/2005 | Lim | A47K 3/32 4/596 |
| 2007/0039199 | A1 * | 2/2007 | Whitman | A47K 10/48 34/443 |
| 2009/0022485 | A1 * | 1/2009 | Madden | A47K 10/48 392/380 |
| 2016/0169553 | A1 * | 6/2016 | Wilder | F24H 3/0417 392/380 |
| 2016/0302629 | A1 * | 10/2016 | Casla Arruiz | A47K 10/48 |
| 2016/0331193 | A1 * | 11/2016 | Brown | A47K 10/48 |
| 2017/0035258 | A1 | 2/2017 | Ricketts | |
| 2018/0036200 | A1 * | 2/2018 | Wilkinson | A61H 33/06 |

* cited by examiner

BODY AIR DRYER FOR A BATHING STALL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles, more specifically, a body drying device utilizing hot air.

SUMMARY OF INVENTION

The body air dryer for a bathing stall is a forced air drying system. The body air dryer for a bathing stall is configured for use with a shower stall. The body air dryer for a bathing stall is configured for use with a bather. The body air dryer for a bathing stall generates a heated air flow that is discharged on to the bather for the purpose of drying the bather after a shower or bath. The body air dryer for a bathing stall comprises a housing, a forced air system, a power circuit, and a water muffler. The forced air system, the power circuit, and the water muffler are contained within the housing. The forced air system generates the heated air flow. The power circuit connects the forced air system to an external power source. The water muffler is a structure that prevents water from entering the forced air system and the power circuit.

These together with additional objects, features and advantages of the body air dryer for a bathing stall will be readily apparent to those of ordinary skill in the art upon reading the following detailed description of the presently preferred, but nonetheless illustrative, embodiments when taken in conjunction with the accompanying drawings.

In this respect, before explaining the current embodiments of the body air dryer for a bathing stall in detail, it is to be understood that the body air dryer for a bathing stall is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the body air dryer for a bathing stall.

It is therefore important that the claims be regarded as including such equivalent construction insofar as they do not depart from the spirit and scope of the body air dryer for a bathing stall. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
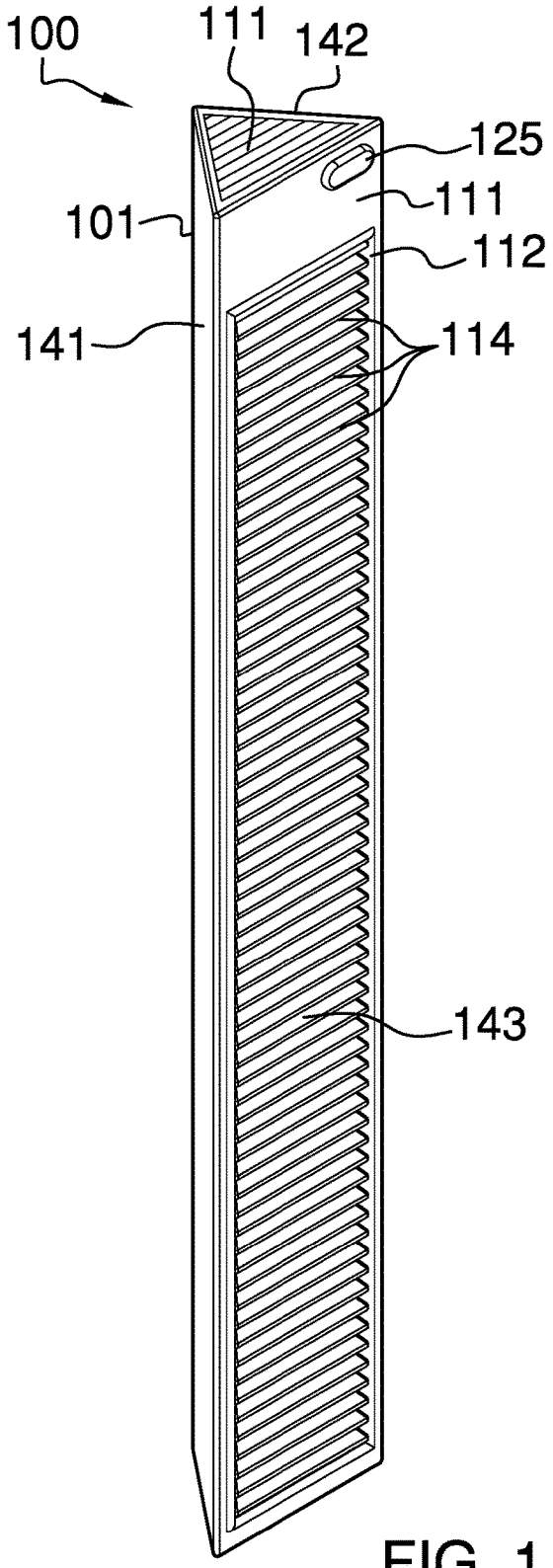
FIG. 1 is a perspective view of an embodiment of the disclosure.
Figure 2:
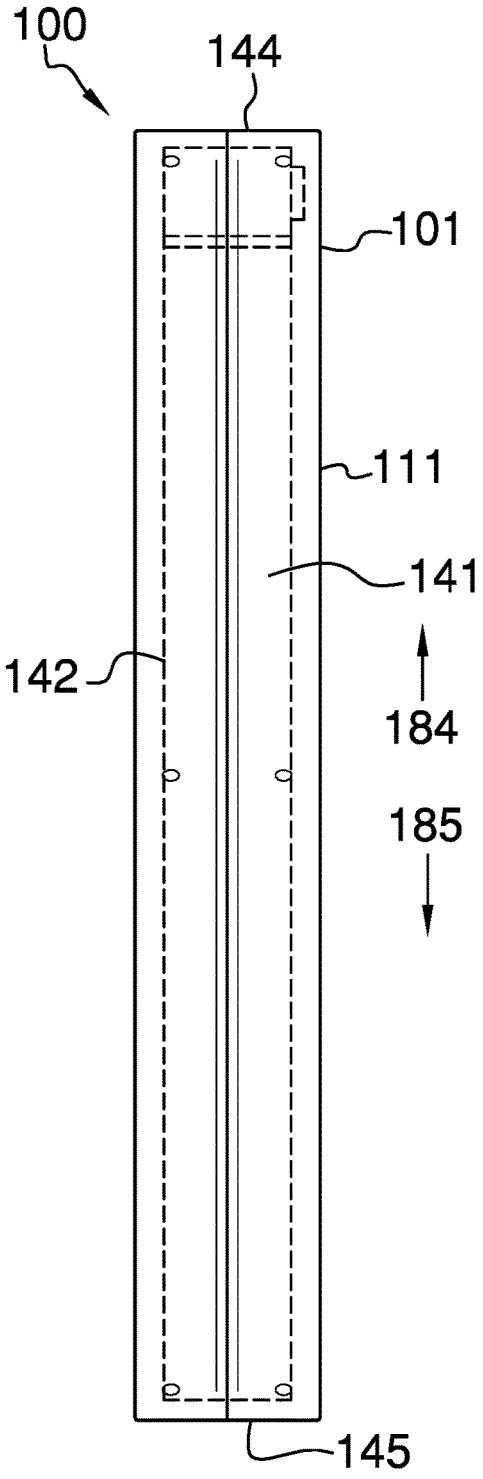
FIG. 2 is a rear view of an embodiment of the disclosure.
Figure 3:
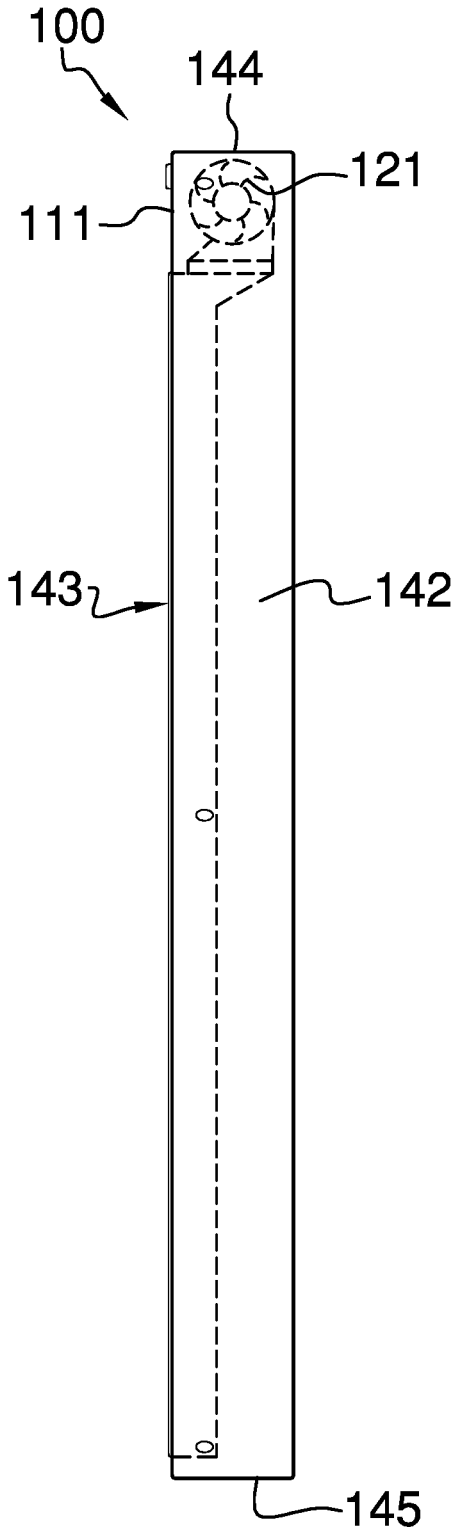
FIG. 3 is a side view of an embodiment of the disclosure.
Figure 4:
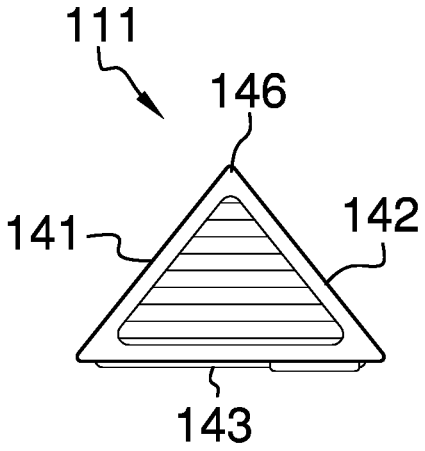
FIG. 4 is a top view of an embodiment of the disclosure.
Figure 5:
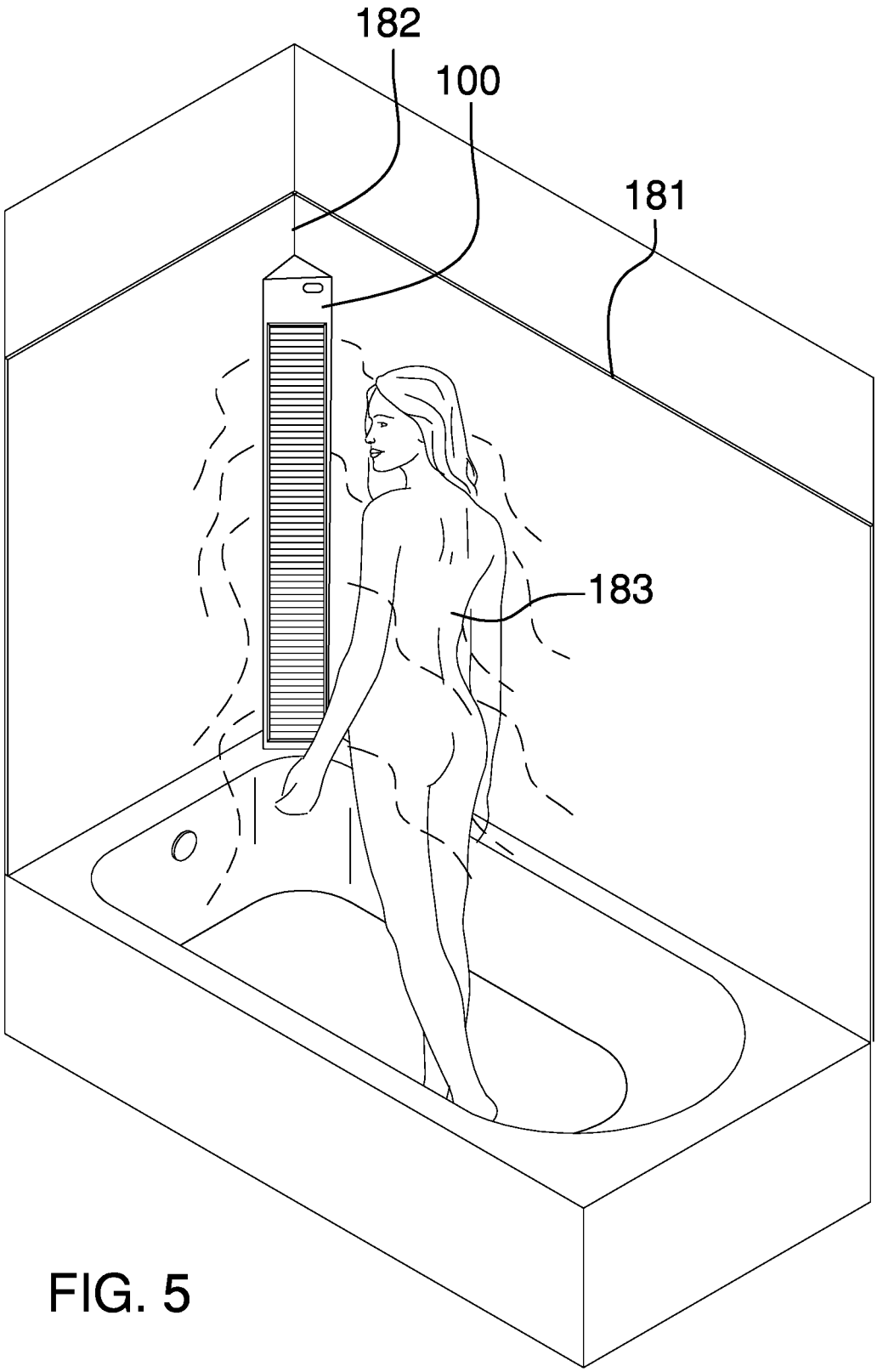
FIG. 5 is an in use view of an embodiment of the disclosure.
Figure 6:
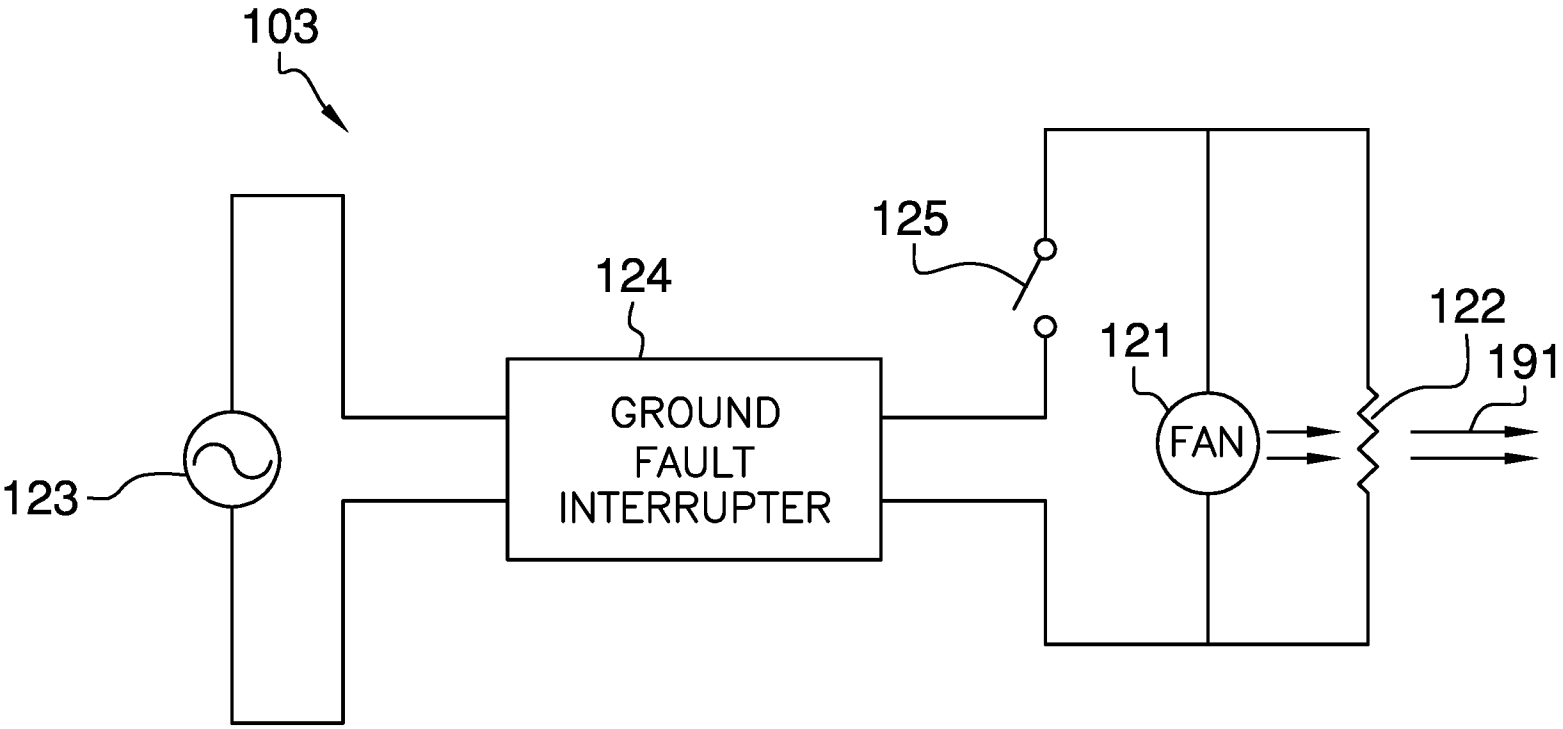
FIG. 6 is a block diagram of an embodiment of the disclosure.
Figure 7:
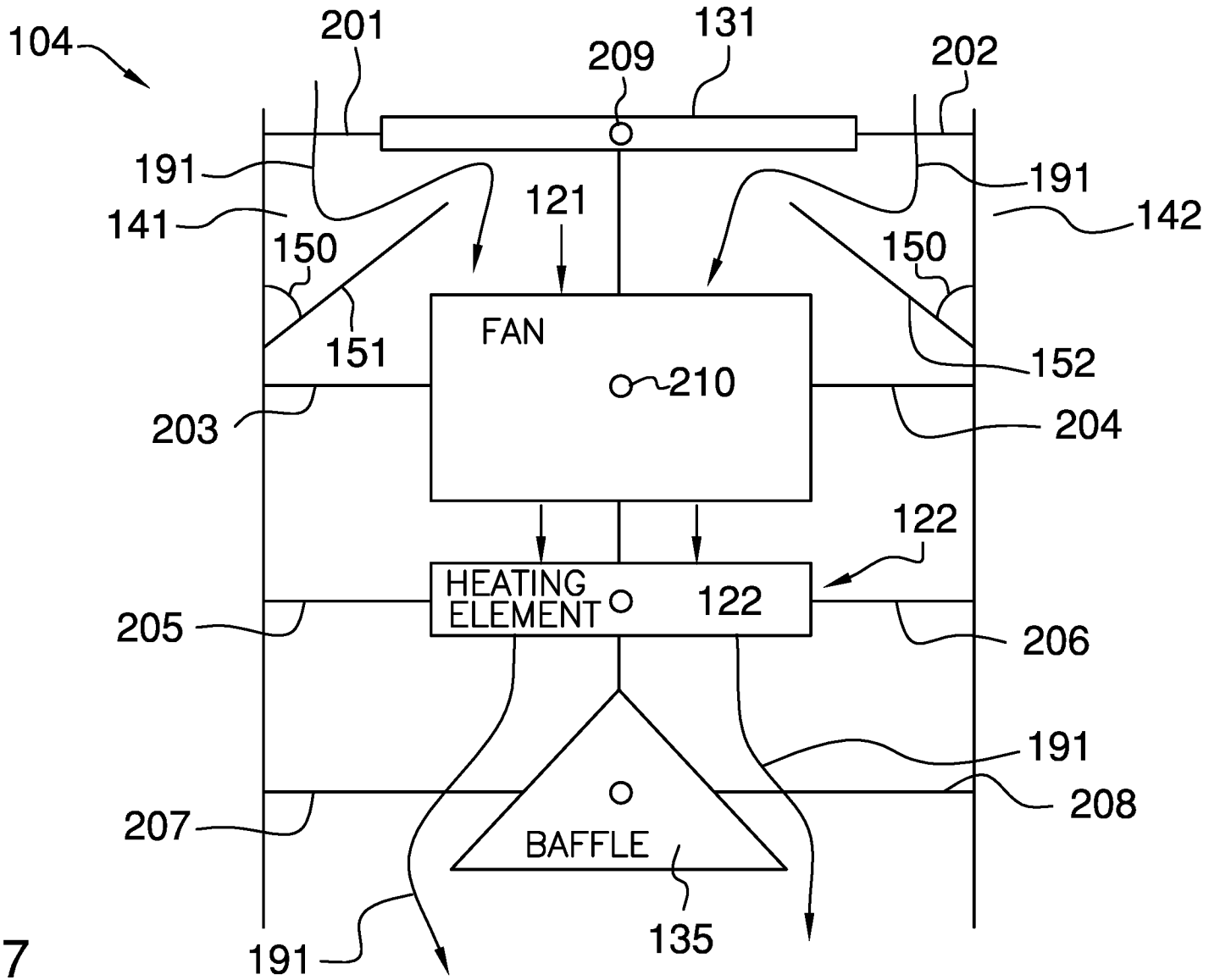
FIG. 7 is a detail view of an embodiment of the disclosure.
Figure 8:
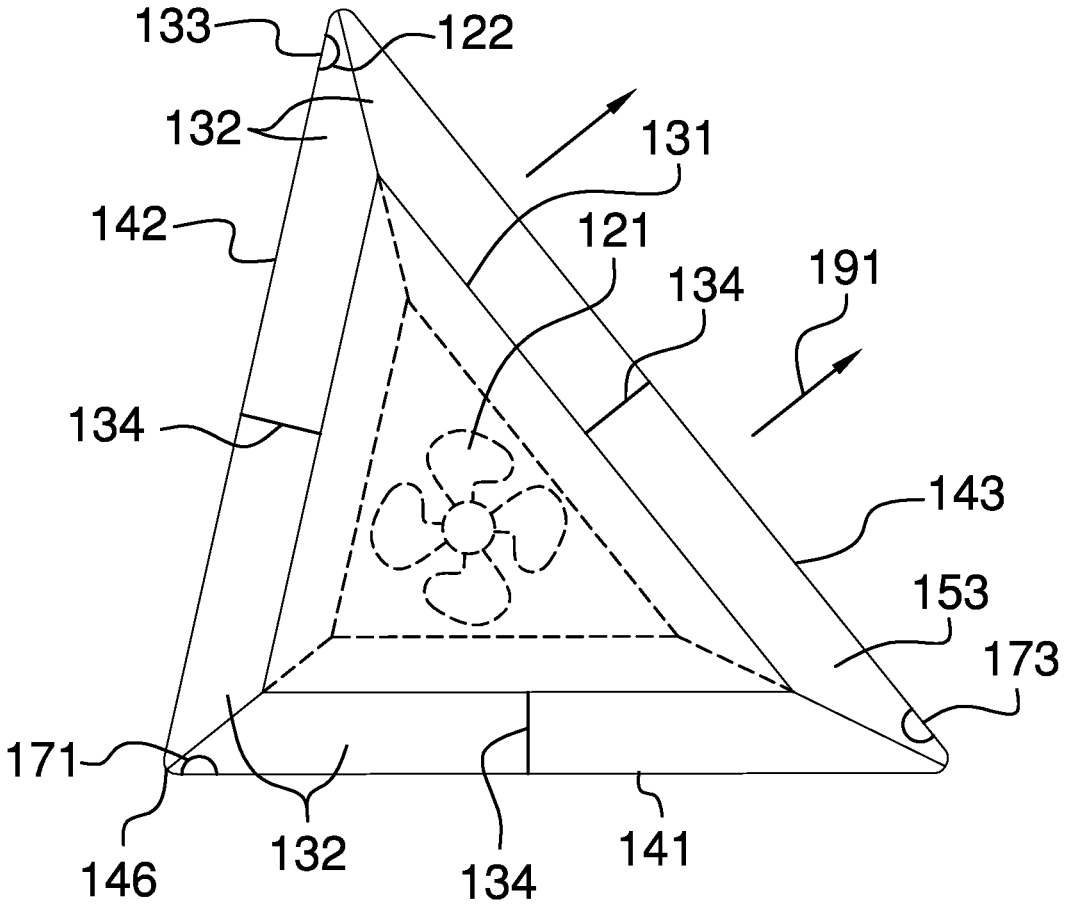
FIG. 8 is a detail view of an embodiment of the disclosure.

Detailed reference will now be made to one or more potential embodiments of the disclosure, which are illustrated in FIGS. 1 through 8.

The body air dryer for a bathing stall 100 (hereinafter invention) is a forced air drying system. The invention 100 is configured for use with a shower stall 181. The invention 100 is configured for use with a bather 183. The invention 100 generates a heated air flow 191 that is discharged on to the bather 183 for the purpose of drying the bather 183 after a hygienic activity. The invention 100 comprises a housing 101, a forced air system 102, a power circuit 103, and a water muffler 104. The forced air system 102, the power circuit 103, and the water muffler 104 are contained within the housing 101. The forced air system 102 generates the heated air flow 191. The power circuit 103 connects the forced air system 102 to an external power source 123. The water muffler 104 is a structure that prevents water from entering the forced air system 102 and the power circuit 103.

The shower stall 181 is a domestic space that is dedicated to bathing activities and showering activities. The shower stall 181 is configured for a wet and humid environment. The shower corner 182 refers to the intersection of two vertical boundaries that define the shower stall 181. The invention 100 is intended to be installed in the shower corner 182. The bather 183 refers to an individual who is performing hygienic activities in the shower stall 181. The heated air flow 191 refers to an air flow that is heated by the forced air system 102 and discharged on to bather 183.

The housing 101 is a rigid casing within which the invention 100 is contained. Air is forced through the housing 101 where it is processed to form the heated air flow 191 which is subsequently discharged on to the bather 183 for the purpose of drying the bather 183. The housing 101 comprises a triangular prism 111, an exhaust vent 112, and an intake vent 113.

The triangular prism 111 forms the outer shell of the housing 101. The triangular prism 111 is formed in the shape of a triangular prism 111. The triangle formed by the triangular prism 111 is an isosceles right triangle. The right angle 146 formed by the triangular prism 111 is located between the two equal sides of the isosceles triangle. The triangular prism 111 comprises a first face 141, a second face 142, a third face 143, a superior 185 end 144, and an inferior 184 end 145.

The first face 141 is a solid rectangular plate that forms a side of the triangular prism 111 that is adjacent to the right angle 146 formed by the triangular prism 111. The second face 142 is a solid rectangular plate that forms a side of the triangular prism 111 that is adjacent to the right angle 146 formed by the triangular prism 111. The third face 143 is a solid rectangular plate that forms the side of the triangular prism 111 that is the hypotenuse of the right triangle formed by the triangular prism 111.

The characteristic shape of the triangular prism 111 is determined by the superior 185 end 144 and the inferior 184 end 145. The superior 185 end 144 forms the superior 185 boundary of the invention 100 during normal use. The intake vent 113 and a portion of the water muffler 104 are formed in the superior 185 end 145. The inferior 184 end 145 forms the inferior 184 boundary of the invention 100 and is the end of the triangular prism 111 that is distal from the superior 185 end 144.

The exhaust vent 112 is an opening that is formed in the third face 143 of the triangular prism 111 through which the heated air flow 191 is discharged. The exhaust vent 112 is further formed with a plurality of rotatable louvers 114 that are used to adjustably direct the heated air flow 191 on to the bather 183 as it is discharged from the exhaust vent 112. Each of the plurality of rotatable louvers 114 is a rectangular plate that is mounted in front of the exhaust vent 112. Each of the plurality of rotatable louvers 114 directs the discharge of the heated air flow 191 towards the bather 183. Methods to use louvers to direct air flow are well known and the heating, cooling, and ventilation arts. The exhaust vent 112 is formed in the third face 143.

The intake vent 113 is an opening that is formed in the superior 185 end 144 of the triangular prism 111. The forced air system 102 draws air through the intake vent 113 for processing into the heated air flow 191. The right angle 146 is a 90 degree angle that is formed by the first face 141 and the second face 142.

The forced air system 102: 1) draws air into the housing 101; 2) pumps the drawn air through the housing 101; 3) heats the drawn air as it passes through the housing 101 to form the heated air flow 191; and, 4) discharges the heated air flow 191 on to the bather 183. The forced air system 102 comprises a fan 121 and a heating element 122.

The fan 121 is a readily and commercially available electrically powered mechanical device. The mounting of the fan 121 within the housing 101 is discussed in greater detail elsewhere in this disclosure. The fan 121 pumps the heated air flow 191 through the forced air system 102 and the housing 101 for processing.

The heating element 122 is a readily and commercially available electrical device. The mounting of the heating element 122 within the housing 101 is discussed in greater detail elsewhere in this disclosure. The heating element 122 heats the heated air flow 191 as it passes through the forced air system 102 and the housing 101. In the first potential embodiment of the disclosure, the fan 121 is mounted directly over the heating element 122 such that the fan 121 will pump an air flow directly over the heating element 122 to create the heated air flow 191.

The fan 121 and the heating element 122 are mounted in the triangular prism 111 such that the center of the fan 121 and the center of the heating element 122 are aligned with the center axis of the triangular prism 111.

The power circuit 103: 1) attaches the forced air system 102 to an external power source 123 that supports the operation of the invention 100; and, 2) initiates and discontinues the operation of the forced air system 102. The power circuit 103 comprises an external power source 123, a ground fault interrupter 124, and a switch 125.

The external power source 123 is an externally provided source of electrical power. In the first potential embodiment of the disclosure, it is assumed that the external power source 123 is the national electric grid. The ground fault interrupter 124 is a readily and commercially available electrical device that ensures that the invention 100 can be used safely. The ground fault interrupter 124 is discussed in greater detail elsewhere in this disclosure. The switch 125 is a readily and commercially available electrical device known as a maintained switch. The switch 125 controls the flow of electricity from the external power source 123 to the forced air system 102. The switch 125 is the power switch of the invention 100.

The water muffler 104 is a barrier structure that is formed within the housing 101. The purpose of the water muffler 104 is to allow the free flow of the heated air flow 191 through the housing 101 while preventing water from reaching the forced air system 102 and the power circuit 103. The water muffler 104 comprises a superior 185 cover 131, a plurality of gutters 132, a plurality of drains 133, a plurality of shafts 134, and a baffle 135.

The superior 185 cover 131 is a triangular plate that is located within the triangular prism 111 in a superior 185 position to the forced air system 102. The purpose of the superior 185 cover 131 is to prevent water drops generated within the shower stall 181 from falling directly into the forced air system 102. The superior 185 cover 131 is positioned such that the center of the superior 185 cover 131 is aligned with the center axis of the triangular prism 111. The superior 185 cover 131 is sized and positioned such that a passage between the superior 185 cover 131 and the perimeter of the superior 185 end 144 of the triangular prism 111 is formed allowing air to flow into the triangular prism 111 and through the exhaust vent 112.

Any water drops that get past the superior 185 cover 131 will be captured by the plurality of gutters 132. Each of the plurality of gutters 132 is a plate that is formed in the shape of a truncated triangle. Each of the plurality of gutters 132 attaches to a face selected from the group consisting of the first face 141, the second face 142, and the third face 143. Each of the plurality of gutters 132 forms a trough that captures water drops that have bypassed the superior 185 cover 131. Each of the plurality of gutters 132 attaches to the selected face: 1) in the manner of a cantilever; and, 2) in a manner that forms a cant 150 between the selected gutter and its associated selected face.

The cant 150 refers specifically to an interior angle formed between any pair selected from the group consisting of the: 1) first face 141 and the first gutter 151; 2) the second face 142 and the second gutter 152; and, 3) the third face 143 and the third gutter 153. The cant 150 is selected such that the free end of any gutter selected from the plurality of gutters 132 projects away from the selected face at an angle in the superior 185 direction. The free end of each of the plurality of gutters 132 extends to a position underneath the superior 185 cover 131.

In the first potential embodiment of the disclosure, plurality of gutters 132 comprises a first gutter 151, a second gutter 152, and a third gutter 153. The first gutter 151 is further defined with a first cant. The second gutter 152 is further defined with a second cant. The third gutter 153 is further defined with a third cant. In the first potential embodiment of the disclosure, the first gutter 151, the second gutter 152, and the third gutter 153 all share the span of arc for their respective cant 150 which will herein after simply be identified as the cant 150.

Each of the plurality of drains 133 is a conduit that is formed within the troughs formed by the plurality of gutters 132 that provides for the drainage of water that has accumulated within the plurality of gutters 132. The plurality of drains comprises a first drain 171, a second drain 172, and a third drain 173. Methods to form drains in structures are well known and documented in the mechanical and plumbing arts.

Each of the plurality of shafts 134 is a rigid rod that: 1) suspends a component selected from the group consisting of the superior 185 cover 131, the fan 121, the heating element 122, and the baffle 135; to 2) a face selected from the group consisting of the first face 141, the second face 142, and the third face 143.

The plurality of shafts 134 comprises a first shaft 201, a second shaft 202, a third shaft 203, a fourth shaft 204, a fifth shaft 205, a sixth shaft 206, a seventh shaft 207, an eighth shaft 208, a ninth shaft 209, a tenth shaft 210, an eleventh shaft 211, and a twelfth shaft 212.

The baffle 135 is a cone shaped device that located within the triangular prism 111 in an inferior 184 position to the heating element 122. The apex of the baffle 135 is proximal to the heating element 122. The base of the baffle 135 is distal from the heating element 122. The base of the baffle 135 forms a barrier that prevents water from splashing up into the forced air system 102 and the power circuit 103. The baffle 135 is positioned in the triangular prism 111 such that the center axis of the baffle 135 is aligned with the center axis of the triangular prism 111.

The assembly of the invention 100 is described in the following 6 paragraphs.

The first shaft 201 attaches the superior 185 cover 131 to the first face 141. The second shaft 202 attaches the superior 185 cover 131 to the second face 142. The third shaft 203 attaches the fan 121 to the first face 141. The fourth shaft 204 attaches the fan 121 to the second face 142. The fifth shaft 205 attaches the heating element 122 to the first face 141. The sixth shaft 206 attaches the heating element 122 to the second face 142. The seventh shaft 207 attaches the plurality of shafts 134 to the first face 141. The eighth shaft 208 attaches the plurality of shafts 134 to the second face 142.

The ninth shaft 209 attaches the superior 185 cover 131 to the third face 143. The tenth shaft 210 attaches the fan 121 to the third face 143. The eleventh shaft 211 attaches the heating element 122 to the third face 143. The twelfth shaft 212 attaches the baffle 135 to the third face 143.

The first gutter 151 attaches to the first face 141 in the manner of a cantilever such that the free end of the first gutter 151 extends away from the first face 141. The first gutter 151 extends away from the first face 141 such that the interior angle between the first gutter 151 and the first face 141 equals the cant 150.

The second gutter 152 attaches to the second face 142 in the manner of a cantilever such that the free end of the second gutter 152 extends away from the second face 142. The second gutter 152 extends away from the second face 142 such that the interior angle between the second gutter 152 and the second face 142 equals the cant 150.

The third gutter 153 attaches to the third face 143 in the manner of a cantilever such that the free end of the third gutter 153 extends away from the third face 143. The third gutter 153 extends away from the third face 143 such that the interior angle between the third gutter 153 and the third face equals the cant 150.

The first drain 171 is located at the vertex formed by the first face 141 and the second face 142. The second drain 172 is located at the vertex formed by the second face 142 and the third face 143. The third drain 173 is located at the vertex formed by the third face 143 and the first face 141.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Arc: As used in this disclosure, an arc refers to a portion of a circumference or a curved perimeter. When applied to an angle, the arc also refers to a measure of an angular span as measured from a circle at the vertex formed by the sides of the angle.

Angle, Interior: As used in this disclosure, an interior angle is a cant that is formed in the perimeter of area wherein the angle of lesser arc that is formed by the cant facing the interior of the bounded area.

Cant: As used in this disclosure, a cant is an angular deviation from one or more reference planes such as a vertical plane or a horizontal plane.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Circuit Breaker: As used in this disclosure, a circuit breaker is a normally closed maintained switch that automatically actuates to an open position should a dangerous condition (such as overcurrent or ground fault) be detected.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone. A cone is a type of quadric surface. The cone is a pyramid with a circular base.

External Power Source: Refers to source of the energy that is externally provided to enable the operation of the present disclosure. Examples of external power sources include, but are not limited to, electrical power sources and compressed air sources.

Fan: As used in this disclosure, a fan is a mechanical device with rotating blades that is used to create a flow or current of air.

Force Of Gravity: As used in this disclosure, the force of gravity refers to a vector that indicates the direction of the pull of gravity on an object at or near the surface of the earth.

Ground Fault Interrupter: As used in this disclosure, a ground fault interrupter is a circuit breaker that is actuated when a "ground fault" is detected. The ground fault interrupter is inserted into a protected electrical circuit such that all authorized electrical currents entering and leaving the protected electrical circuit are routed through the ground fault interrupter. The ground fault interrupter detects the ground fault by comparing the current entering protected electrical circuit through the ground fault interrupter and the current exiting the protected electrical circuit through the ground fault interrupter. Should a current mismatch be detected the ground fault interrupter actuates to the open position. A ground fault interrupter is also referred to as a ground fault circuit interrupter.

Heating Element: As used in this disclosure, a heating element is a resistive wire that is used to convert electrical energy into heat. Common metal combinations used to form heat elements include a combination of nickel and Chromium (typical: 80/20), a combination of iron, chromium and aluminum (typical 70/25/5), a combination of copper, nickel, iron, and manganese (typical 66/30/2/2) (use for continuously hot), or a platinum.

Housing: As used in this disclosure, a housing is a rigid casing that encloses and protects one or more devices.

Inferior: As used in this disclosure, the term inferior refers to a directional reference that is parallel to and in the same direction as the force of gravity.

Louver: As used in this disclosure, a louver is a (generally rectangular) plate that is installed in a vent for the purpose of directing air flow.

Maintained Switch: A used in this disclosure, a maintained switch is a switch that maintains the position that was set in the most recent switch actuation.

National Electric Grid: As used in this disclosure, the national electric grid is a synchronized and highly interconnected electrical network that distributes energy in the form of electric power from a plurality of generating stations to consumers of electricity.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal. When made of wood, a plate is often referred to as a board.

Prism: As used in this disclosure, a prism is a 3 dimensional geometric structure wherein: 1) the form factor of two faces of the prism correspond to each other; and, 2) the two corresponding faces (commonly called the ends of the prism) are parallel to each other. In this disclosure, when further description is required a prism will be named for the geometric or descriptive name of the form factor of the two corresponding faces. If the form factor of the two corresponding faces has no clearly established or well-known geometric or descriptive name, the term irregular prism will be used. The center axis of a prism is defined as a line that joins the center point of the first corresponding face of the prism to the center point of the second corresponding face of the prism. The center axis of a prism is otherwise analogous the center axis of a cylinder. A prism wherein the ends are circles is commonly referred to as a cylinder.

Superior: As used in this disclosure, the term superior refers to a directional reference that is parallel to and in the opposite direction of the force of gravity.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Truncated: As used in this disclosure, a geometric object is truncated when an apex, vertex, or end is cut off by a line or plane.

Vent: As used in this disclosure, a vent is an opening in a structure that allows air to enter or leave the structure.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A body drying device comprising:

a housing, a forced air system, a power circuit, and a water muffler;

wherein the forced air system, the power circuit, and the water muffler are contained within the housing;

wherein the body drying device is configured for use with a bather;

wherein the body drying device is installed in a shower stall;

wherein the body drying device discharges a heated air flow on to the bather;

wherein the forced air system generates the heated air flow;

wherein the power circuit connects the body drying device to an external power source;

wherein the water muffler is a structure that prevents water from entering the forced air system and the power circuit;

wherein the housing comprises a triangular prism, an exhaust vent, and an intake vent;

wherein the triangular prism is further defined with a center axis;

wherein the exhaust vent and the intake vent are formed on the triangular prism;

wherein the triangular prism forms the outer shell of the housing;

wherein the triangular prism is formed in the shape of a triangular prism;

wherein the triangle formed by the triangular prism is an isosceles right triangle;

wherein the right angle formed by the triangular prism is located between the two equal sides of the isosceles triangle;

wherein the water muffler comprises a superior cover, a plurality of gutters, a plurality of drains, a plurality of shafts, and a baffle;

wherein the plurality of gutters are attached to the triangular prism;

wherein the plurality of drains are attached to the triangular prism;

wherein one or more shafts selected from the plurality of shafts attach the superior cover to the triangular prism;

wherein one or more shafts selected from the plurality of shafts attach the baffle to the triangular prism;

wherein one or more shafts selected from the plurality of shafts attach the fan to the triangular prism;

wherein one or more shafts selected from the plurality of shafts attach the heating element to the triangular prism.

2. The body drying device according to claim 1 wherein the housing is a rigid casing;

wherein forced air system processes air through the housing;

wherein the air processed through the housing forms the heated air flow.

3. The body drying device according to claim 2 wherein the forced air system draws air into the housing;

wherein the forced air system pumps the drawn air through the housing;

wherein the forced air system heats the drawn air as it passes through the housing to form the heated air flow;

wherein the forced air system discharges the heated air flow on to the bather.

4. The body drying device according to claim 3 wherein the power circuit electrically connect the forced air system to an external power source;

wherein the power circuit initiates and discontinues the operation of the forced air system.

5. The body drying device according to claim 4 wherein the water muffler is a barrier structure that is formed within the housing;

wherein the purpose of the water muffler prevents water from entering the housing.

6. The body drying device according to claim 5 wherein the triangular prism comprises a first face, a second face, a third face, a superior end, and an inferior end;

wherein the first face is a solid rectangular plate that forms a side of the triangular prism that is adjacent to the right angle formed by the triangular prism;

wherein the second face is a solid rectangular plate that forms a side of the triangular prism that is adjacent to the right angle formed by the triangular prism;

wherein the third face is a solid rectangular plate that forms the side of the triangular prism that is the hypotenuse of the right triangle formed by the triangular prism;

wherein the characteristic shape of the triangular prism is determined by the superior end and the inferior end;

wherein the superior end forms the superior boundary of the body drying device;

wherein the intake vent is an opening that is formed in the superior end;

wherein a portion of the water muffler is mounted in the superior end;

wherein the inferior end forms the inferior boundary of the body drying device;

wherein the exhaust vent is an opening that is formed in the third face of the triangular prism;

wherein the heated air flow is discharged through the exhaust vent.

7. The body drying device according to claim 6 wherein the exhaust vent is further formed with a plurality of rotatable louvers;

wherein each of the plurality of rotatable louvers adjustably directs direction of discharge of the heated air flow from the exhaust vent;

wherein each of the plurality of rotatable louvers is a rectangular plate that is mounted in front of the exhaust vent.

8. The body drying device according to claim 7 wherein the forced air system comprises a fan and a heating element;

wherein the fan is an electrically powered mechanical device;

wherein the fan pumps the heated air flow through the forced air system;

wherein the heating element is an electrical device;

wherein the heating element heats the heated air flow as it passes through the forced air system;

wherein the fan pumps the heated air flow directly over the heating element;

wherein the fan mounts in the triangular prism such that the center of the fan aligns with the center axis of the triangular prism;

wherein the heating element mounts in the triangular prism such that the center of the center of the heating element aligns with the center axis of the triangular prism.

9. The body drying device according to claim 8 wherein the power circuit comprises a ground fault interrupter, and a switch;

wherein the ground fault interrupter is a circuit breaker that interrupts the operation of the forced air system should a ground fault be detected;

wherein the switch is a maintained switch;

wherein the switch controls the flow of electricity from the external power source to the forced air system.

10. The body drying device according to claim 9 wherein the superior cover is a triangular plate that is located within the triangular prism in a superior position to the forced air system;

wherein the superior cover is positioned such that the center of the superior cover is aligned with the center axis of the triangular prism;

wherein the superior cover is sized and positioned such that a passage between the superior cover and the perimeter of the superior end of the triangular prism.

11. The body drying device according to claim 10 wherein each of the plurality of gutters is a plate that is formed in the shape of a truncated triangle;

wherein each of the plurality of gutters forms a trough that captures water drops that have bypassed the superior cover;

wherein each of the plurality of gutters attaches to a face selected from the group consisting of the first face, the second face, and the third face;

wherein each of the plurality of gutters attaches to the selected face in the manner of a cantilever;

wherein each of the plurality of gutters attaches to the selected face in a manner that forms a cant between the selected gutter and its associated selected face.

12. The body drying device according to claim 11 wherein the cant is an interior angle that formed between any pair selected from the group consisting of the: 1) first face and the first gutter; 2) the second face and the second gutter; and, 3) the third face and the third gutter;

wherein the span of the arc of any first selected cant is equal to the span of the arc of any second selected cant;

wherein span of the arc of the cant is selected such that the free end of any gutter selected from the plurality of gutters projects away from the selected face at an angle in the superior direction;

wherein the free end of each of the plurality of gutters extends to a position underneath the superior cover;

wherein each of the plurality of drains is a conduit that is formed within the plurality of gutters to provide for the drainage of water that has accumulated within the plurality of gutters.

13. The body drying device according to claim 12 wherein the baffle is a cone shaped structure;

wherein the baffle is located within the triangular prism in an inferior position to the heating element;

wherein the apex of the baffle is proximal to the heating element;

wherein the base of the baffle is distal from the heating element;

wherein the baffle is positioned in the triangular prism such that the center axis of the baffle is aligned with the center axis of the triangular prism.

14. The body drying device according to claim 13 wherein each of the plurality of shafts is a rigid rod that suspends a component selected from the group consisting of the superior cover, the fan, the heating element, and the baffle to a face selected from the group consisting of the first face, the second face, and the third face.

15. The body drying device according to claim 14 wherein the plurality of shafts comprises a first shaft, a second shaft, a third shaft, a fourth shaft, a fifth shaft, a sixth shaft, a seventh shaft, and an eighth shaft;

wherein the first shaft attaches the superior cover to the first face;

wherein the second shaft attaches the superior cover to the second face;

wherein the third shaft attaches the fan to the first face;

wherein the fourth shaft attaches the fan to the second face;

wherein the fifth shaft attaches the heating element to the first face;

wherein the sixth shaft attaches the heating element to the second face;

wherein the seventh shaft attaches the plurality of shafts to the first face;

wherein the eighth shaft attaches the plurality of shafts to the second face.

16. The body drying device according to claim 15 wherein the plurality of gutters comprises a first gutter, a second gutter, and a third gutter;

wherein the first gutter attaches to the first face in the manner of a cantilever such that the free end of the first gutter extends away from the first face;

wherein the first gutter extends away from the first face such that the interior angle between the first gutter and the first face equals the cant;

wherein the second gutter attaches to the second face in the manner of a cantilever such that the free end of the second gutter extends away from the second face;

wherein the second gutter extends away from the second face such that the interior angle between the second gutter and the second face equals the cant;

wherein the third gutter attaches to the third face in the manner of a cantilever such that the free end of the third gutter extends away from the third face;

wherein the third gutter extends away from the third face such that the interior angle between the third gutter and the third face equals the cant.

17. The body drying device according to claim 16 wherein the plurality of drains comprises a first drain, a second drain, and a third drain;

wherein the first drain is located at the vertex formed by the first face and the second face;

wherein the second drain is located at the vertex formed by the second face and the third face;

wherein the third drain is located at the vertex formed by the third face and the first face.

18. The body drying device according to claim 17 wherein the plurality of shafts further comprises a ninth shaft, a tenth shaft, an eleventh shaft, and a twelfth shaft;

wherein the ninth shaft attaches the superior cover to the third face;

wherein the tenth shaft attaches the fan to the third face;

wherein the eleventh shaft attaches the heating element to the third face;

wherein the twelfth shaft attaches the baffle to the third face.

* * * * *